US007280440B2

(12) United States Patent
Goeller et al.

(10) Patent No.: US 7,280,440 B2
(45) Date of Patent: Oct. 9, 2007

(54) TIMEPIECE INCLUDING A CONTROL DEVICE FOR A STRIKING MECHANISM FITTED WITH A RESILIENT TRANSMISSION ELEMENT

(75) Inventors: Eric Goeller, Les Hôpitaux Vieux (FR); Jérôme Chevalier, Le Brassus (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 11/426,781

(22) Filed: Jun. 27, 2006

(65) Prior Publication Data

US 2006/0291335 A1 Dec. 28, 2006

(30) Foreign Application Priority Data

Jun. 27, 2005 (EP) ..... 05105715

(51) Int. Cl.
*G04B 21/02* (2006.01)
*G04B 23/02* (2006.01)
*G04F 1/00* (2006.01)

(52) U.S. Cl. ..... 368/75; 368/98; 368/244

(58) Field of Classification Search ..... 368/72, 368/75, 243, 244, 260, 269, 273
See application file for complete search history.

(56) References Cited

U.S. PATENT DOCUMENTS 402,343 A 4/1889 Morlet
2,644,294 A * 7/1953 Ditisheim ..... 368/260
2,786,524 A * 3/1957 Schwab ..... 368/246
4,508,456 A * 4/1985 Hepfer et al. ..... 368/262
7,021,819 B2 * 4/2006 Schmiedchen ..... 368/147

FOREIGN PATENT DOCUMENTS

CH 54713 2/1911
WO 00/36473 6/2000

OTHER PUBLICATIONS

European Search Report issued in corresponding application No. EP 05 10 5715 completed May 19, 2006.

* cited by examiner

*Primary Examiner*—Vit W Miska
(74) *Attorney, Agent, or Firm*—Griffin & Szipl, P.C.

(57) ABSTRACT

The invention proposes a timepiece (10) including a striking mechanism (20), and including a control device (28) for activating an element (22) releasing the striking mechanism (20), via a control surface (64) carried by a piston (32), characterized in that a resilient transmission element (68) is arranged between the piston (32) and the release element (22) and in that the travel of the piston (32) includes an active travel, from the rest position of the piston (32) to an intermediate position corresponding to the stop position of the release element (22), during which the travel of the piston (32) is connected to the travel of the release element (22) via the resilient transmission element (68), and a passive travel during which the piston (32) slides against the resilient transmission element (68).

12 Claims, 3 Drawing Sheets

TIMEPIECE INCLUDING A CONTROL DEVICE FOR A STRIKING MECHANISM FITTED WITH A RESILIENT TRANSMISSION ELEMENT

This application claims priority from Europen Patent Application No. 05105715.6 filed Jun. 27,2005, the entire disclosure of which is incorported herein by reference.

FIELD OF THE INVENTION

The invention concerns a timepiece including a striking mechanism.

The invention concerns more particularly a timepiece including a case containing a watch movement and at least one striking mechanism, and including a control device provided for actuating a striking release mechanism, of the type wherein the control device includes an external manipulation member, which controls the travel of a piston inside the case between a rest position and an end of travel position, from upstream to downstream, of the type wherein the piston drives a control surface which is pressed against the release element to drive the release element to a stop position determined by the striking mechanism, and of the type wherein the piston is fitted with a resilient return element which is pressed against the case so as to draw the piston resiliently towards its rest position.

BACKGROUND OF THE INVENTION

A timepiece of this type is disclosed, for example, in WO Patent application No 00/36473. This patent application discloses and shows a watch including an external bolt for controlling the sliding of the piston, against the return force of a helical compression spring which is arranged around a stem forming the piston. The spring is inserted between the inner sliding block and the edge of a guide hole for the stem.

The control surface is arranged at the free end of the piston. It abuts against an arm which actuates the striking mechanism. This arm is generally pivotably connected to a pivoting rack which winds a striking barrel and which releases the striking mechanism. The angular travel of the rack varies as a function of the time to be indicated.

When the user wishes to release the striking mechanism, he moves the bolt against the return spring. When the rack has travelled an angular distance determined by the time to be indicated, it is stopped, which blocks the sliding of the piston and the sliding of the bolt.

However, the user does not always cease pressing on the bolt as soon as it reaches the stop. Thus, the rack and the other parts of the striking mechanism which are connected thereto are subjected to the pressure applied by the user, which can cause a malfunction of the striking mechanism, or even damage the latter.

It is an object of the invention to overcome these drawbacks.

SUMMARY OF THE INVENTION

Therefore, the invention proposes a timepiece of the type described hereinbefore, characterized in that a resilient transmission element is arranged between the piston and the release element, and in that the travel of the piston includes an active travel from the piston rest position to an intermediate position corresponding to the release element stop position, during which the piston travel is connected to the travel of the release element via the resilient transmission element, and a passive travel, during which the piston slides against the resilient transmission element.

Owing to the insertion of the resilient transmission element, the stress applied by the user on the external manipulation member is not directly transmitted to the striking mechanism. This reduces the risks of a malfunction of the striking mechanism, and increases the longevity of the mechanism. Moreover, the piston travel is no longer dependent upon the position of the release element, which enables a more precise travel to be obtained for the piston, and which facilitates adjustment of the control-device as regards its stop positions.

According to other features of the invention:

- the control surface is carried by an intermediate sliding block which is slidably mounted in relation to the piston, in that the resilient transmission element is inserted between the intermediate sliding block and the piston, and, during the active travel of the piston, the intermediate sliding block is slidably connected to the piston by the resilient transmission element, and, during the passive travel, the piston slides relative to the sliding block against the resilient transmission element;
- the resilient transmission element draws the intermediate sliding block against a shoulder of the piston oriented upstream;
- the shoulder is arranged on an upstream stud which is fixed to the piston;
- the resilient transmission element is a compression spring;
- the intermediate sliding block includes a body which extends substantially parallel to the piston, which is delimited by an upstream lug and by a downstream lug, the upstream lug is drawn in abutment against the piston shoulder, and the resilient transmission element is inserted between the upstream stud and the downstream lug;
- the control surface is formed by a shoulder made in the body of the intermediate sliding block;
- the control surface is fixed to the piston, and the release element includes a pivoting arm which is drawn towards the piston control surface by the resilient transmission element;
- the return element is inserted between a downstream stud fixed to the piston and an associated support surface of the case;
- the case includes an overall cylindrical peripheral wall and the piston extends generally along a circumferential sliding direction, along the inner face of the peripheral wall;
- the piston has the overall shape of a stem of circular section which extends along the circumferential sliding direction;
- the release element pivots and includes a rack.

BRIEF DESCRIPTION OF THE DRAWINGS

Other features and advantages of the present invention will appear more clearly upon reading the following detailed description, made with reference to the annexed drawings, given by way of non limiting example and in which.

DETAILED DESCRIPTION OF THE ILLUSTRATIVE EMBODIMENTS

Figure 2:
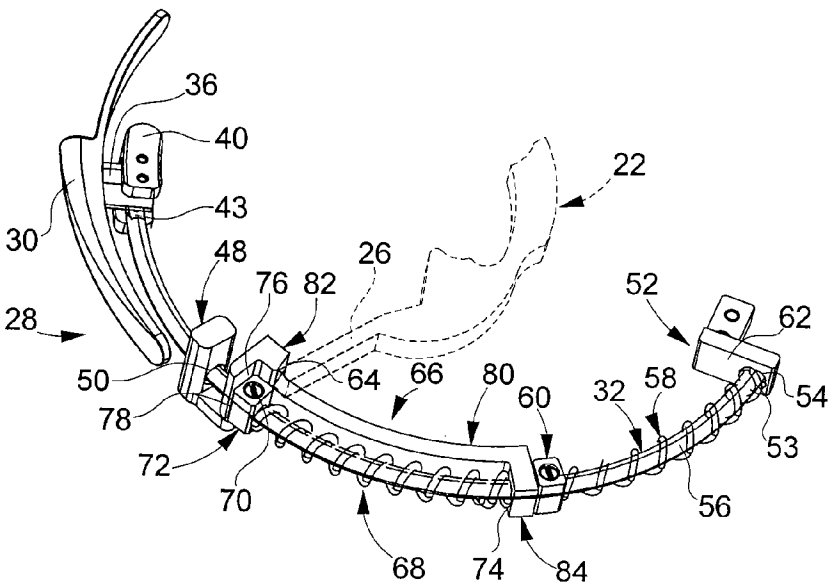
FIG. 2 is a perspective view which schematically shows the control device of FIG. 1.

FIGS. 1 to 4 show a timepiece 10 which is made in accordance with the teaching of the invention. Timepiece 10 is a wristwatch 10 here, it being clear that the invention also applies to any other type of timepiece, such as a pocket watch, pendant watch, clip watch, ship's watch, etc. The watch 10 shown includes a case 12 with a middle part 14 which delimits a sealed inner chamber 16 which houses a watch movement 18 and a striking mechanism 20 for emitting sounds upon demand. Case 12 here has an overall cylindrical shape and an axis A1 perpendicular to the plane of FIG. 1.

Movement 18 and striking mechanism 20 are not described in detail, since their construction is known. Striking mechanism 20 could be formed for example by a quarter, five-minute, minute repeater, etc. Including one or several hammers cooperating with gongs that are known. In the figures, striking mechanism 20 is symbolized by a rack 22 which allows a striking barrel to be wound and the striking mechanism to be released.

Watch 10 includes a control device 28 which cooperates with a release element 22 for striking mechanism 20, said release element 22 being formed here by rack 22.

According to the embodiment shown, rack 22 is pivotably mounted about an axis parallel to the axis A1 of case 12. Rack 22 comprises a toothed section 24 and an arm 26 provided for controlling the pivoting of rack 22.

Figure 1:
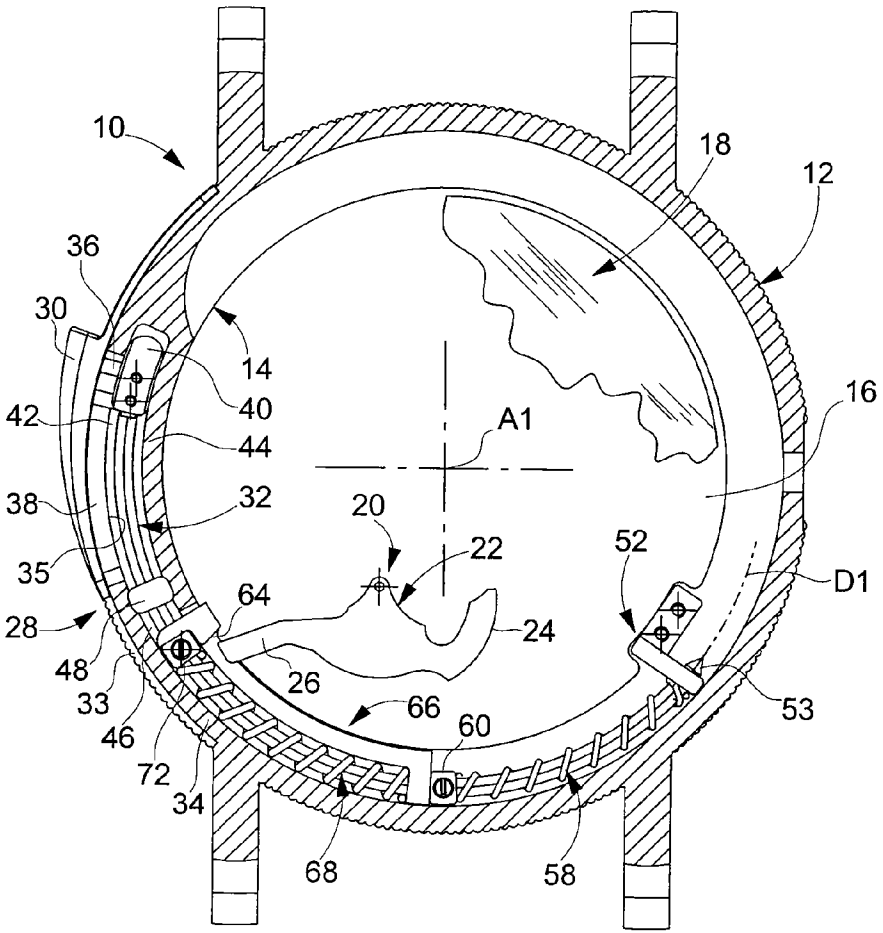
FIG. 1 is a view along a radial cross-sectional plane which schematically shows a timepiece fitted with a control device for a striking mechanism in accordance with the teaching of the invention, the control device being in the rest state.

Rack 22 includes an angular rest position, which is illustrated in FIG. 1, and twelve angular stop positions Pa, which respectively correspond to the twelve hours to be indicated. In FIG. 2, rack 22 occupies its rest position Pa at twelve o'clock and, in FIG. 4, rack 22 occupies its rest position Pa at one o'clock.

It will be noted that the stop position Pa of rack 22 is defined by striking mechanism 20. More specifically, it is the angular position of an hour snail (not shown) which determines the stop position Pa of rack 22.

Figure 4:
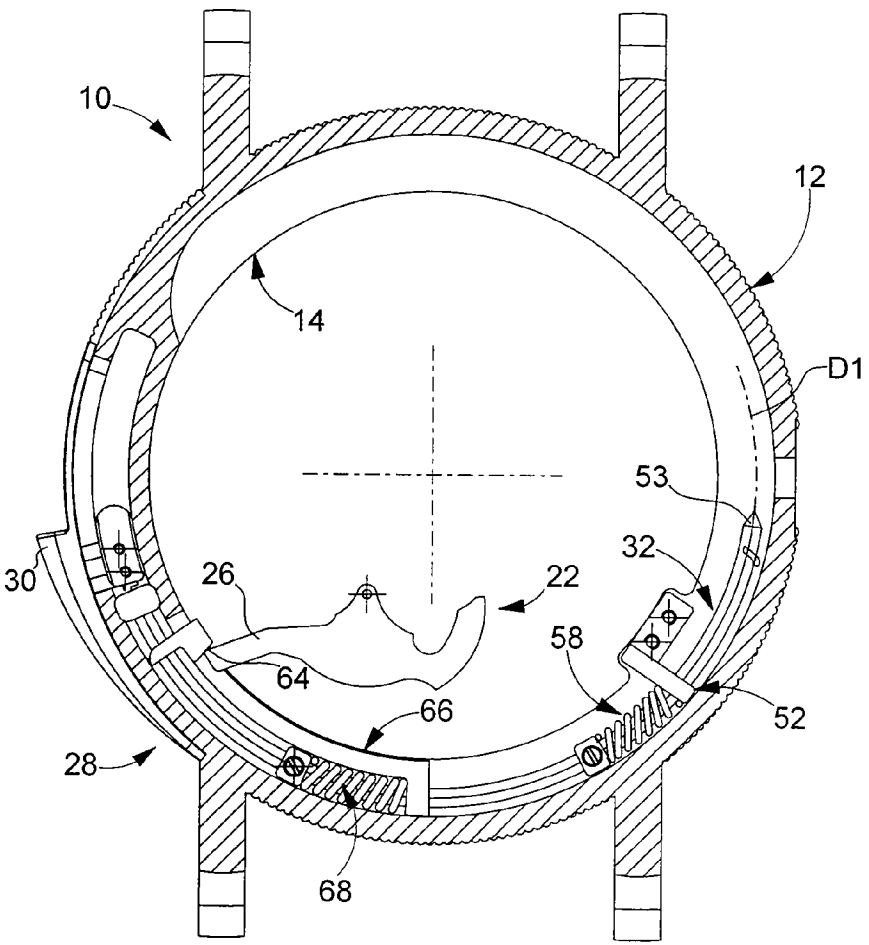
FIG. 4 is a similar view to that of FIG. 1 which illustrates an activated state of the control device for a stop position of the striking mechanism at one o'clock.
Figure 3:
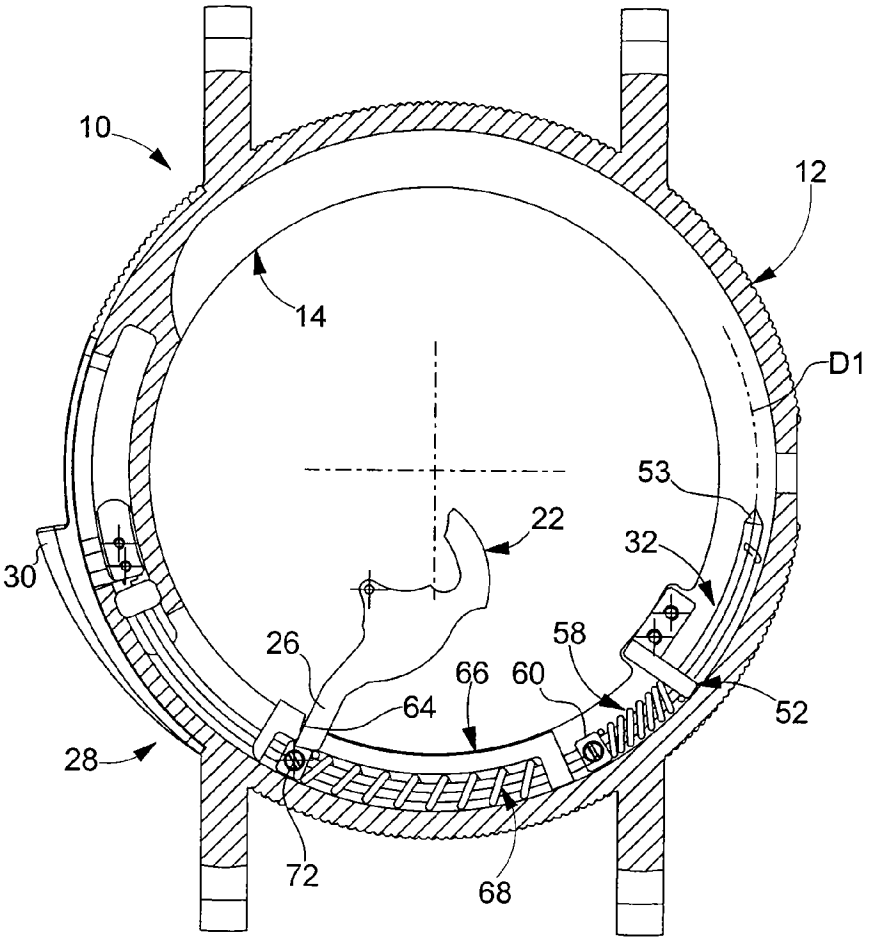
FIG. 3 is a similar view to that of FIG. 1 which illustrates an activated state of the control device for a stop position of the striking mechanism at twelve o'clock.

Control device 28 includes an external manipulation member 30 called a bolt which controls the sliding of a piston 32 inside case 12, between a rest position Pr, illustrated in FIG. 1, and an end of travel position Pf, illustrated by FIGS. 3 and 4.

Piston 32 has here the shape of a curved stem or circular section which extends, over an angular sector, along a circumferential sliding direction D1, substantially parallel to the peripheral wall 34 of middle part 14.

In the following description, an upstream to downstream orientation will be used in a non-limiting manner, along the circumferential sliding direction D1, from the rest position Pr to the end of travel position Pf of piston 32.

Bolt 30 slides along the external face 33 of the peripheral wall 34 of middle part 14. Bolt 30 has a connecting arm 36 which extends radially inside case 12, through a circumferential slot 38 arranged in peripheral wall 34. Connecting arm 36 is hinged on an inner sliding block called a shoe 40 which slides along inner face 35 of peripheral all 34, in a guide compartment 42, and which is hinged on the upstream end 43 of piston 32.

Guide compartment 42 is made in the radial thickness of middle part 14. It is delimited, inwards, by an inner wall 44 which forms, at its downstream end, a recess, in relation to peripheral wall 34, delimiting a passage 46 for piston 32. Piston 32 extends inside guide chamber 42 and in inner compartment 16 of case 12.

Advantageously, a sealing insert 48 is welded in passage 46. This insert 48 includes a hole 50 of circular section fitted to the diameter of piston 32 to grip and seal it and thus provide a seal between inner chamber 16 and guide compartment 42.

A guide plate 52 is secured to middle part 14, inside inner compartment 16, on the side of the downstream end 53 of piston 32. This guide plate 52 extends here transversely to piston 32 and it includes a guide hole 54 provided for receiving the sliding downstream end section 56 of piston 32.

As shown in the Figures, when piston 32 occupies its rest position Pr, its downstream end 53 is at the same height as guide plate 52 and, when piston 32 occupies its end of travel position Pf, its downstream end 53 is shifted downstream in relation to guide plate 52.

Piston 32 is fitted with a resilient return element 58 which is inserted between middle part 14 and piston 32 so as to draw piston 32 resiliently towards its rest position Pr, downstream here. This return element 58 is formed here by a helical compression spring, called a return spring 58, which is wound around the downstream end section 56 of piston 32 and which is inserted between a downstream stop stud 60, secured to piston 32, and the upstream face 62 of guide plate 52.

Piston 32 carries a control surface 64 which is provided to abut against arm 26 of rack 22 so as to cause it to pivot in the anti-clockwise direction looking at the Figures.

In accordance with the teaching of the Invention, a resilient transmission element 68 is arranged between piston 32 and release element 22. Moreover, the travel of piston 32 includes an active travel, from the rest position Pr of piston 32, to an intermediate position Pi corresponding to the stop position Pa of release element 22, during which the travel of piston 32 is connected to the travel of rack 22 by resilient transmission element 68, and a passive travel, to the end of travel position Pf of piston 32, during which piston 32 slides against the resilient transmission element 68.

According to the embodiment shown here, control surface 32 is arranged on an intermediate sliding block 66 which is slidably mounted in relation to piston 32. A resilient transmission element 68 is inserted between piston 32 and intermediate sliding block 66. Resilient transmission element 68 is formed here by a helical compression spring, called transmission spring 68, which is inserted between the downstream face 70 of an upstream stop stud 72, secured to piston 32, and a first support surface 74, oriented upstream, belonging to intermediate sliding block 66.

Intermediate sliding block 66 includes a second support surface 76, oriented downstream, which abuts against an upstream shoulder 78 of upstream stud 72, when piston 32 occupies its rest position Pr, via the effect of the let down stress applied by transmission spring 68 on intermediate sliding block 66.

Intermediate sliding block 66 includes here a body 80 in the shape of a curved plate which extends substantially parallel to the inner face 35 of peripheral wall 34, on the side of axis A1 of case 12 in relation to piston 32. This body 80 is provided at its upstream end with an upstream lug 82 and at its downstream end with a downstream lug 84. Piston 32 passes through upstream and downstream lugs 82 and 84 so as to guide intermediate sliding block 66 as it slides on piston 32. The first support surface 74 is arranged on the upstream face of downstream lug 84 and the second support surface 76 is arranged on the downstream face of upstream lug 82.

Body 80 includes a shoulder which is arranged here in proximity to the upstream lug 82 and which forms the control surface 64 oriented downstream.

The operation of control device 28 according to the invention is as follows.

From the rest state, illustrated in FIG. 1, the user activates control device 28 by sliding bolt 30 along middle part 14, downstream, which causes an equivalent movement of piston 32 inside case 12. Piston 32 moves downstream against the return force of return spring 58, which is increasingly compressed, progressively as piston 32 comes closer to its end of travel position Pf.

During a first part of the activating travel of piston 32, called the active travel, intermediate sliding block 66 moves with piston 32, via the effect of transmission spring 68 which holds intermediate sliding block 66 pressed against upstream stud 70. The movement of intermediate sliding block 66 causes, via the control surface 64, rack 22 to pivot.

The active travel ends when piston 32 reaches an intermediate position Pi corresponding to stop position Pa of rack 22, for example the twelve o'clock position illustrated in FIG. 3, if the hour measured by movement 18 of watch 10 is the twelfth hour. Control surface 64 is then locked against arm 26 of rack 22, such that intermediate sliding block 66 can no longer move downstream.

From this intermediate position Pi of piston 32, a second part of the activating travel of piston 32, called the passive travel, starts. During the passive travel, upstream stud 72 continues to move with piston 32 while compressing transmission spring 68, since intermediate sliding block 66 can non longer move downstream. Thus, piston 32 continues to move downstream, beyond its intermediate position Pi, until it reaches its own downstream end position called the end of travel position Pf, without applying any stress on rack 22 other than the let down stress of transmission spring 68.

It will be noted that the active travel and the passive travel of piston 32 continuously follow each other. During the passive travel, the compression of transmission spring 68 is added to the compression of return spring 58.

Preferably, the stiffness of transmission spring 68 is less than the stiffness of return spring 58. Moreover, the stiffness of transmission spring 68 is calibrated such that the resilient force which draws intermediate sliding block 66 downstream is greater than the pivoting resistance force of rack 22, to allow the movement of piston 32 to be transmitted to rack 22.

Owing to the invention, whatever the force exerted by the user on bolt 30, striking mechanism 20 cannot be excessively loaded by control device 28. Moreover, the maximum travel of bolt 30 and piston 32 is always the same, whatever the stop position Pa of rack 22.

Thus, as can be seen in FIG. 4, when the stop position Pa of rack 22 is the one o'clock position, the pivoting of rack 22 is less than in the twelve o'clock release configuration, but the travel of piston 32 and bolt 30 is always the same. The compression of transmission spring 68 compensates for the angular pivoting difference of arm 26 of rack 22, this compression being greater in the one o'clock stop position Pa, compared to the twelve o'clock stop position Pa.

At the end of the travel of piston 32 downstream, the user releases bolt 30 which then returns to its rest position, with piston 32, via the effect of the let down stress of return spring 58. Moreover, the let down stress of transmission spring 68 causes intermediate sliding block 66 to return to its own rest position, illustrated in FIGS. 1 and 2. Simultaneously, rack 22 returns to its angular rest position, pivoting here in the clockwise direction, and it releases the striking mechanism.

According to the embodiment shown, the end of travel position Pf of piston 32 is determined by the abutment of bolt 30 against an associated stop surface arranged on middle part 14. The abutment of bolt 30 against this stop surface is dampened by the compression effect of the two springs 58, 68.

Figure 5:
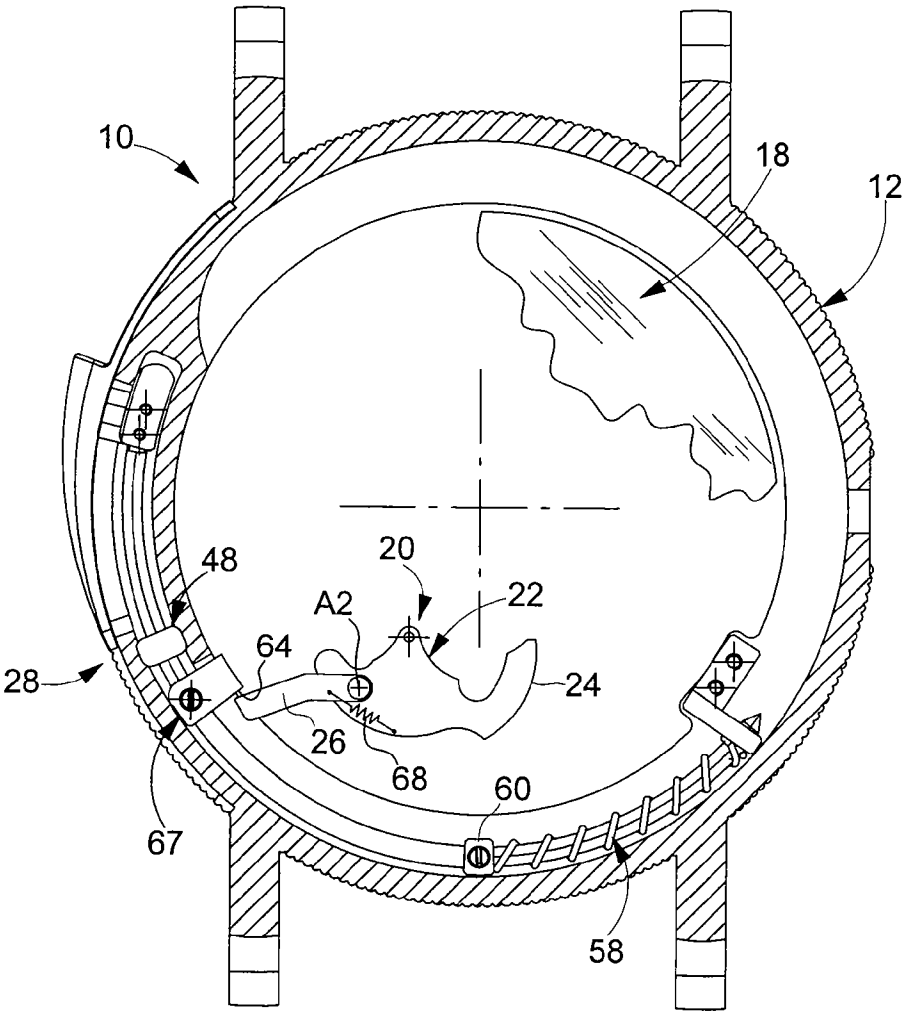
FIG. 5 is a similar view to that of FIG. 1 which illustrates a variant of the control device including an arm pivoting on a rack.

According to a variant of control device 28 according to the invention, which is shown in FIG. 5, transmission spring 68 can be inserted between arm 26 and rack 22. In this configuration, arm 26 is pivotably mounted about an axis A2 on rack 22 and transmission spring 68, here a detent spring, draws arm 26 towards control surface 64. Control surface 64 is arranged here on a stud 67 fixed to piston 32, the presence of sliding block 66 no longer being necessary.

The operation of this variant is similar to the operation of the previously described control device 28. As far as the stop position Pa of rack 22, during the active travel of piston 32, arm 26 is pivotably connected to rack 22. From the stop position Pa of rack 22, during the passive travel of piston 32, arm 26 retracts by pivoting about its axis A2 against transmission spring 68.

It will be noted that control device 28 according to the invention can includes additional intermediate drive parts, for example between piston 32 and rack 22.

What is claimed is:

1. A timepiece including a case containing a watch movement and at least one striking mechanism, and including a control device for actuating an element releasing the striking mechanism, of the type wherein the control device includes an external manipulation member, which controls the travel of a piston inside the case between a rest position and an end of travel position, from upstream to downstream, of the type wherein the piston drives a control surface which abuts against the release element to drive the release element towards a stop position determined by the striking mechanism, and of the type wherein the piston is fitted with a resilient return element which abuts on the case so as to draw the piston resiliently towards its rest position, wherein a resilient transmission element is arranged between the piston and the release element and wherein the travel of the piston includes an active travel, from the rest position of the piston to an intermediate position corresponding to the stop position of the release element, during which the travel of the piston is connected to the travel of the release element via the resilient transmission element, and a passive travel during which the piston slides against the resilient transmission element.

2. The timepiece according to claim 1, wherein the control surface is carried by an intermediate shoulder which is slidably mounted in relation to the piston, and wherein the resilient transmission element is inserted between the intermediate sliding block and the piston, and wherein, during the active travel of the piston, the intermediate sliding block is slidably connected to the piston by the resilient transmission element and, during the passive travel, the piston slides relative to the sliding block against the resilient transmission element.

3. The timepiece according to claim 2, wherein the resilient transmission element draws the intermediate sliding block against a shoulder of the piston oriented upstream.

4. The timepiece according to claim 3, wherein the shoulder is arranged on an upstream stud which is fixed to the piston.

5. The timepiece according to claim 1, wherein the resilient transmission element is a compression spring.

6. The timepiece according to claim 4, wherein the resilient transmission element is a compression spring, and wherein the intermediate sliding block includes a body which extends substantially parallel to the piston, which is delimited by an upstream lug and by a downstream lug, and wherein the upstream lug is drawn in abutment against the shoulder of the piston, and wherein the resilient transmission element is inserted between the upstream stud and the downstream lug.

7. The timepiece according to claim 6, wherein the control surface is formed by a shoulder made in the body of the intermediate sliding block.

8. The timepiece according to claim 1, wherein the control surface is fixed to the piston, and wherein the release element includes a pivoting arm which is drawn towards the control surface of the piston by the resilient transmission element.

9. The timepiece according to claim 1, wherein the return element is inserted between a downstream stud fixed to the piston and an associated support surface of the case.

10. The timepiece according to claim 1, wherein the case includes a generally cylindrical peripheral wall and wherein the piston extends overall in a circumferential sliding direction, along the inner face of the peripheral wall.

11. The timepiece according to claim 10, wherein the piston has the general shape of a stem of circular section which extends along the circumferential sliding direction.

12. The timepiece according to claim 1, wherein the release element pivots and includes a rack.

* * * * *